US006082908A

United States Patent [19]

Tumidei

[11] Patent Number: 6,082,908

[45] Date of Patent: Jul. 4, 2000

[54] APPARATUS FOR PROCESSING A PHOTOSENSITIVE MEDIUM

[75] Inventor: Daniele Tumidei, Forli', Italy

[73] Assignee: Gipco S.r.l., Forli', Italy

[21] Appl. No.: 09/214,884

[22] PCT Filed: Jul. 14, 1997

[86] PCT No.: PCT/IB97/00863

§ 371 Date: Aug. 20, 1999

§ 102(e) Date: Aug. 20, 1999

[87] PCT Pub. No.: WO98/02781

PCT Pub. Date: Jan. 22, 1998

[51] Int. Cl.[7] ..... G03D 3/08

[52] U.S. Cl. ..... 396/615; 620/617; 620/625

[58] Field of Search ..... 396/612, 615, 396/625, 636, 617, 620

[56] References Cited

U.S. PATENT DOCUMENTS 5,477,300 12/1995 Fujimoto et al. ..... 396/568

FOREIGN PATENT DOCUMENTS 0 620 494 A1 10/1994 European Pat. Off. .
WO 92/22853 12/1992 WIPO .
WO 96/14601 5/1996 WIPO .

*Primary Examiner*—D. Rutledge
*Attorney, Agent, or Firm*—William J. Sapone, Esq.; Nims, Howes, Collison, Hansen & Lackert

[57] ABSTRACT

The improved apparatus for processing a photosensitive medium comprises a tank 1, having a substantially semi-cylindrical shape and provided with an input opening 1*a* and output opening 1*b*.

A transporting means 50 is provided above the tank 1, consisting of a pair of input rollers 51, a pair of output rollers 52 and a conveyor 53, fit to route a sheet 2 from the output opening 1*b* to the input opening 1*a*.

There are also provided an input guide 41 and an output guide 42, fit to guide the sheet 2 along a closed loop including the tank 1, or to the apparatus exit door.

6 Claims, 2 Drawing Sheets

APPARATUS FOR PROCESSING A PHOTOSENSITIVE MEDIUM

TECHNICAL FIELD

The present invention relates to the technical field concerning the printing of snapshots on a photosensitive medium.

Particularly, the present invention relates to an apparatus for processing a photosensitive medium, paper or film for instance, carrying a photographic image previously exposed therein.

BACKGROUND ART

It is known that reproducing images on a photosensitive medium, a negative photographic paper for instance, consists of placing said paper in a lightproof room, and then exposing it with light carrying information relative to the image to be reproduced.

Said light can be produced, for instance, by a lamp of a suitable power and colour temperature; it is conveyed by an optical device, through a film carrying a negative print of the image to be reproduced and then to the photosensitive surface of the photographic paper.

According to further reproduction modes, equally known to a skilled technician, the photosensitive medium can consist of autopositive photographic paper, either self-developing or not. It can be exposed by a light source that lights a film carrying the positive image, or by the light directly coming from a subject to be photographed, by means of a suitable photographic camera.

At this point, the image is in a hidden state, and it is subsequently developed and made stable by submitting the photographic paper to suitable chemical processes.

Said processes usually comprise the steps of immersing the photographic paper into a first developing bath, for a first pre-defined period of time, during which the image is developed; the paper sheet is then immersed into a second bath, containing a fixing or bleaching liquid, for a second pre-defined period of time. One or more immersions into a water bath follow, in order to remove the fixing traces. The photographic paper is then dried.

The above described developing process is carried out automatically by known apparatuses, often with some variants and improvements.

Said apparatuses consist of a series of consecutively placed tanks, each containing a suitable processing liquid, at a given temperature, and of dragging members, fit to convey a photosensitive medium into said tanks according to a pre-defined timing. A continuous web made of the above medium, previously exposed with photographic images, is then inserted into the developing tank first, then into the fixing or bleaching tank, and finally into the washing tank. The web is subsequently dried and cut, in order to separate each photogram.

Apparatuses like the one described above require, in order to operate correctly, that each tank is loaded with large quantities of the respective developing product. Said products must be replaced after a given number of operating cycles, since their efficiency tends to decrease; otherwise, small quantities of new product have to be periodically added to the exhausting product. Thus, it is very difficult to keep the physical parameters of the developing products constant, which is necessary to have a constant output quality. Moreover, it is difficult to maintain a constant temperature inside the tanks, which is also very important to achieve good quality printing results. Finally, power consumption is normally high, because big quantities of developing products must be thermoregulated.

A further apparatus for developing a single sheet of photosensitive medium is also disclosed in the Italian patent Application N. B094A 000481, in the name of the same Applicant. Said apparatus is of the so-called micro-tank or laminar tank type, and solves most of the aforesaid problems by using a developing tank having a very small internal volume, which is contained inside a thermoregulating device.

Said developing tank is fit to receive a sheet of photosensitive medium to be processed inside a laminar hollow. It is fed in sequence with developing products, fixing products and washing products, generally in a liquid state, by means of suitable, separate loading means. Each product stays into the tank just for the time required to operate optimally, after that it is flown out of the tank by means of draining means. This latter is for instance made of a solenoid valve, connected to a conduit, which conveys said products toward one or more draining or recycling containers.

The photosensitive sheet is thus processed in a sequential way, by a developing cycle, eventually followed by one or more washing cycles, and then by a fixing cycle, which is in turn followed by one or more tank washing cycles.

The aforesaid device carries out the sheet processing operations in an economic, functional and completely automatic way but, since it works with a single tank, it can suffer for some problems relating a contamination of the developing product by the fixing product. This can especially happen because of undesired leakage of fixing product occurring on the means for loading said product. Said leakage is generally due to some residual dripping from the output nozzle of said loading means. Normally it is limited to one or two drips of fixing product but, if this happens during a developing cycle, the features of the developing product can be substantially modified.

Moreover the operation of said device is usually not very fast, since it carries out the developing and fixing cycles in a sequential way, furthermore interposing one or more tank washing cycles in between.

A further micro-tank apparatus, disclosed in the Italian patent application N. B095A 000399, in the name of the same Applicant, is provided with a pair of small-sized tanks, of the above described type, which are cascade-operating. One of those carries out the developing cycle, and the remaining one carries out the fixing and washing cycles for a sheet of photosensitive medium. This guarantees a better safety against the developing product contamination, and speeds up the processing operations when several photosensitive sheets have to be processed. Indeed, with the above described apparatus, a subsequent photosensitive sheet can be developed when a previous sheet is subject to the fixing treatment.

The above described processing apparatuses don't attain completely satisfactory operating results when the developing and fixing times are comparable with the time required for inserting and taking out the photosensitive sheet into and from the tank. In fact, because of the time required for inserting or for taking out the sheet, the lower portion of this latter stays into contact with the developing products for a longer time than its upper portion. Since the market now offers developing products which allow a substantial reduction of the photosensitive medium processing times, thus speeding up the whole processing operations, said difference can lead to some visible effects on the processed photosensitive sheet.

DISCLOSURE OF THE INVENTION

It is an object of the present invention to propose an improved micro-tank apparatus for processing a photosensitive medium which guarantees a perfect processing homogeneity even when very fast processing products are used.

The aforesaid object is achieved by an improved apparatus for processing a photosensitive medium, comprising: at least a tank, featuring a laminar cavity fit to receive processing products for a sheet made of photosensitive medium, and to receive also said sheet, in order to develop a latent image car ried by the same, said laminar cavity being shaped like a rounded "U", having its concavity facing upwardly, the above tank being also provided at its opposite ends with at least two openings, respectively an input opening, fit to receive said sheet, and an output opening, fit to allow said sheet to be transferred out of said laminar cavity; thermoregulating means, surrounding said tank and fit to regulate its temperature to a pre-defined value; loading means of said products inside said tank; draining means of said products; guiding means of said sheet, fit to guide this latter into said tank and out therefrom, the position of said guiding means being also adjustable to allow said sheet to be routed along a closed loop.

BRIEF DESCRIPTION OF THE DRAWINGS

The characteristic features of the invention are set out in the following, with particular reference to the accompanying drawings, in which.

MODE OF CARRYING OUT THE INVENTION

Referring now to said figures, numeral 1 indicates a tank suitably sized for arrange a sheet 2 made of photosensitive medium inside it, together with a small quantity of processing products of known type.

Tank 1 is externally provided with known thermoregulating means 10, comprising a low thermal conductivity covering, combined with a laminar electric resistor. This latter is fit to regulate the tank 1 temperature to pre-defined values, which are optimised to allow a latent image, exposed with known techniques on a side of the sheet 2, to be developed.

Tank 1 is of substantially semi-cylindrical shape and it is provided, at its opposite ends, with an input opening 1*a* and with an output opening 1*b*, both of those face upwardly. Said openings are wide enough to allow the sheet 2 to enter the tank 1 from the input opening 1*a* and to exit therefrom from the output opening 1*b*.

Figure 1:
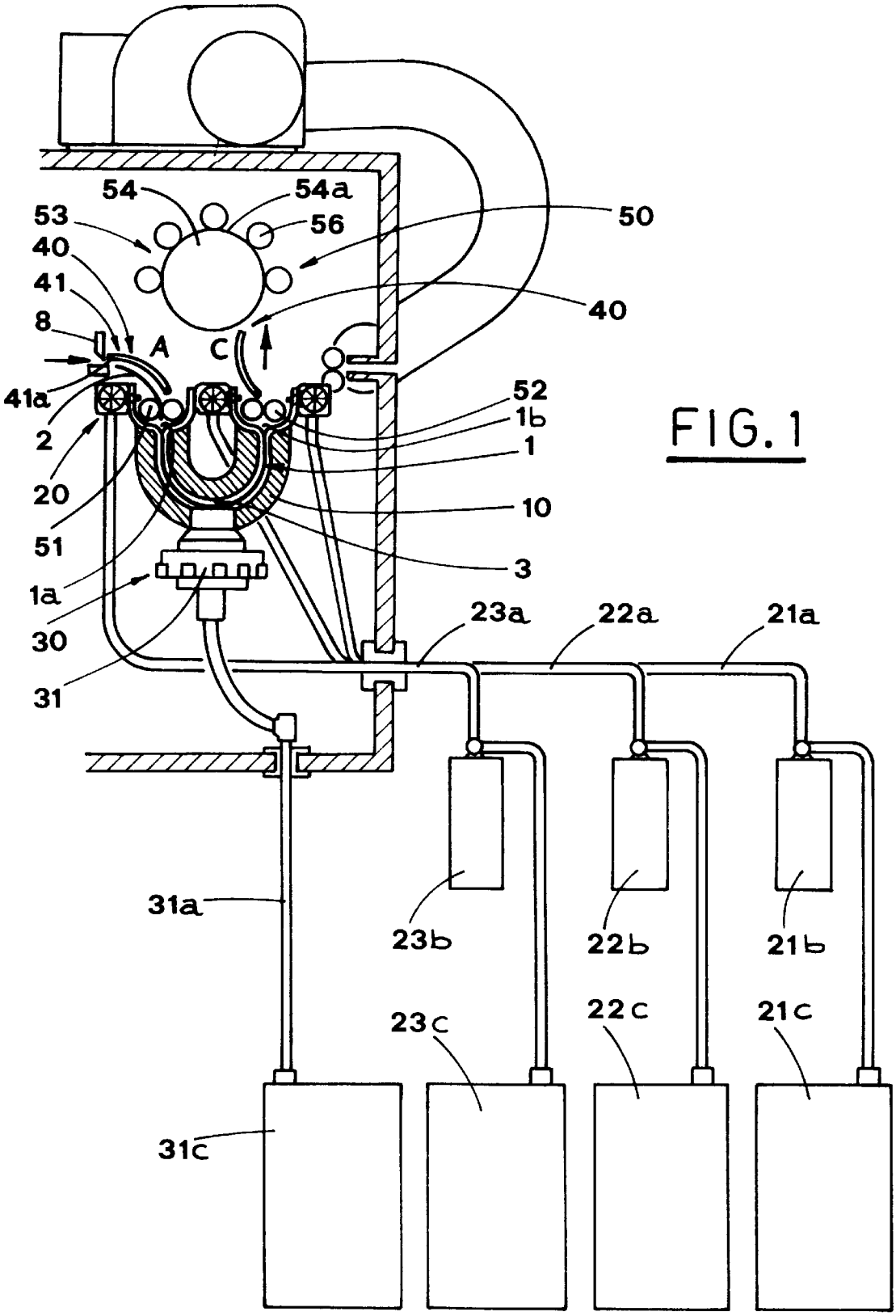
FIG. 1 shows a schematic sectional view of the apparatus of the present invention, during an input operating phase.

The intermediate portion 3 of the tank 1, comprised between openings 1*a*,1*b* is a laminar cavity which is shaped like a rounded "U", having its concavity facing upwardly (see, for instance, FIG. 1).

Near the input opening 1*a* and the output opening 1*b*, the tank 1 is furthermore provided with loading means 20 of processing products. Said means 20 consists of a nozzle for development liquid 21, which is connected to a first measuring pump 21*b*, and then to a first container 21*c*, by means of a first duct 21*a*; of a nozzle for fixing or bleaching liquid 22, which is connected to a second measuring pump 22*b*, and then to a second container 22*c*, by means of a second duct 22*a*; of a nozzle for washing liquid 23, which is connected to a third measuring pump 23*b*, and then to a third container 23*c*, by means of a third duct 23*a*.

The tank 1 is also provided with draining means 30, fit to drain the processing products therefrom, placed at the lowest part of the laminar cavity 3 thereof. The draining means 30 consist of a draining valve 31, which is connected to a fourth container 31*c* by means of a fourth duct 31*a*.

The aforesaid loading means 20 and draining means 30 are operated, in a mutual phase relationship and according to known operating sequences, by an electronic control unit, not shown in the accompanying drawings, in order to load and unload all the processing products.

Figure 2:
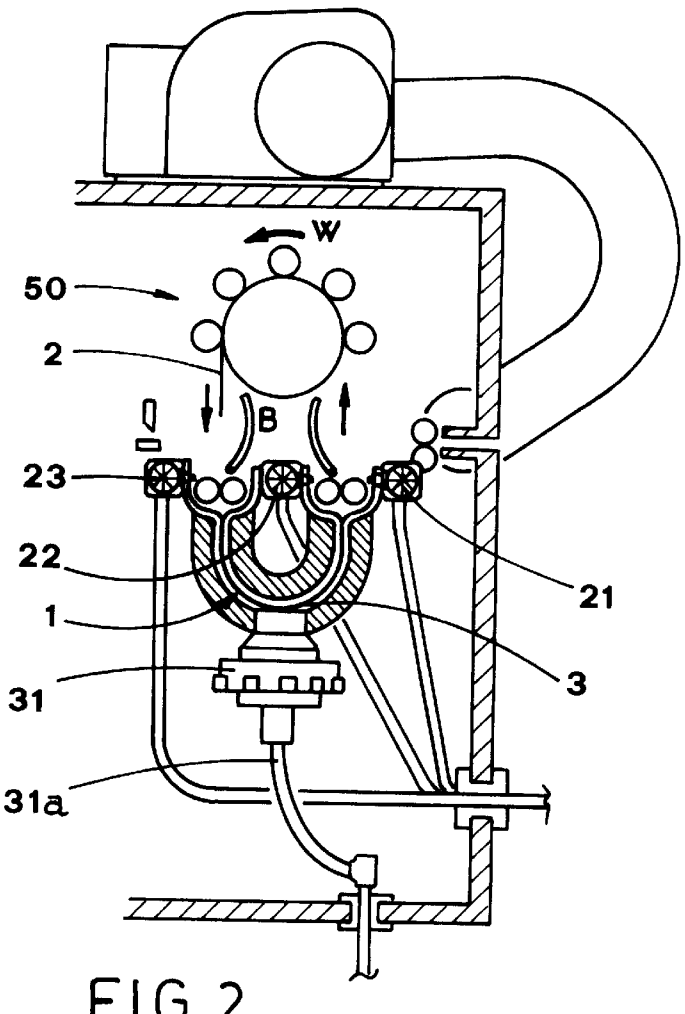
FIG. 2 shows a schematic view of the same apparatus, during a sheet transport operating phase.

Above the input opening 1*a* and the output opening 1*b* there is provided a guiding means 40 for the sheet 2, which comprises an input guide 41 and an output guide 42. The input guide 41 consists of a curved plate, the lower end thereof is placed immediately above the input opening 1*a*. The input guide 41 is pivotable about said lower end, and it is fit to be moved between a sheet 2 input position A (see FIG. 1), wherein the upper end 41*a* of the input guide 41 is placed just above a cutter 8, thus allowing the sheet 2 to be guided toward the input opening 1*a*, and a raised position B (see FIG. 2), wherein the upper end 41*a* is raised and do not interferes with the sheet 2 path.

Figure 3:
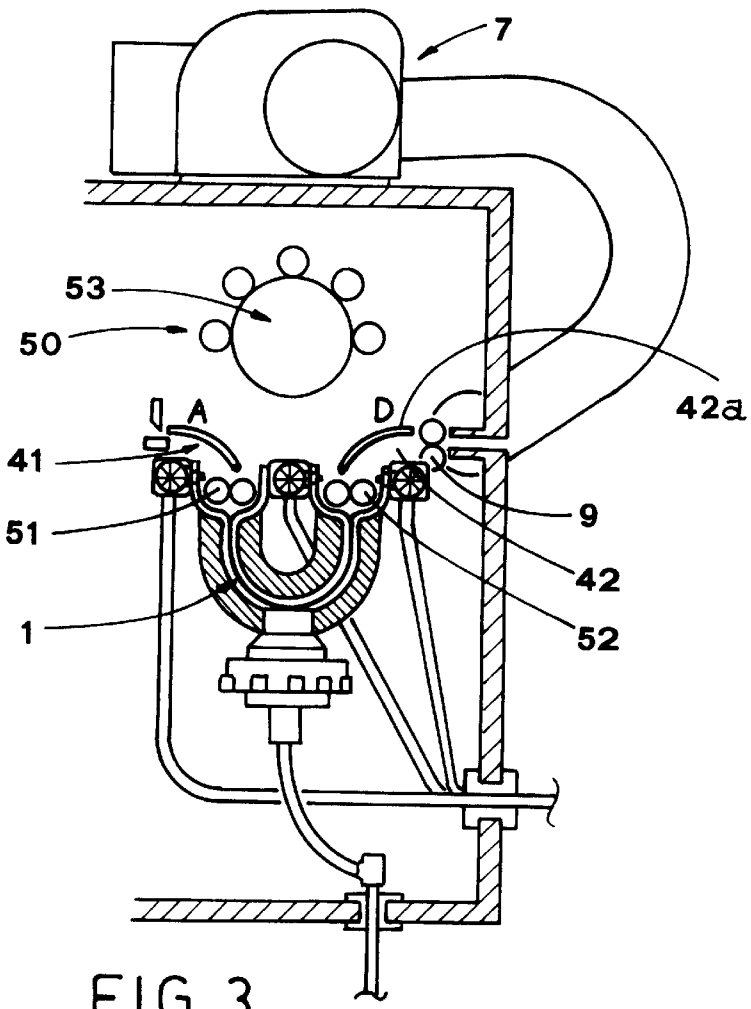
FIG. 3 shows a schematic view of the apparatus, during an output operating phase.

In a similar way the output guide 42 also consists of a curved plate, the lower end thereof is placed immediately above the output opening 1*b*, symmetrically with respect to the input guide 41. The output guide 42 is pivotable about its lower end, and it is fit to be moved between a raised position C (see FIG. 1), wherein the upper end 42*a* is raised and does not interfere with the sheet 2 path, and an output position D (see FIG. 3). When in this latter position, the upper end 42*a* of the output guide 42 is placed near a pair of ejection rollers 9.

The operation of guides 41,42 is controlled by the aforementioned electronic control unit, in a phase relationship with the operation of the loading means 20 and of the draining means 30.

Conveying means 50 is provided above the tank 1, fit to transfer the sheet 2, according to a pre-defined looping sequence, into the tank 1, then out of it, and then into the tank 1 again.

Said conveying means 50 comprises a pair of motor-driven, counter-rotating input rollers 51, a pair of motor-driven, counter-rotating output rollers 52, which are respectively place immediately above the input opening 1*a* and immediately above the output opening 1*b*, and a conveyor 53, symmetrically arranged above the tank 1.

Said conveyor 53 substantially consists of a motor-driven roller 54, rotatably and symmetrically placed above the tank 1, and of a plurality of freely rotatable small rollers 56, parallel with respect to the roller 54, whose external surface contacts the upper portion 54*a* of the external surface of this latter. The small rollers 56 are fit to guide the sheet 2 along said upper portion 54*a*.

The operation of the conveying means 50 is also controlled by the aforesaid electronic control unit, in a phase relationship with the operation of the loading means 20, draining means 30 and guiding means 40.

The working of the present improved apparatus for printing of a photosensitive medium is described in the following, from a starting condition shown in FIG. 1, wherein a sheet 2, carrying a latent image to be developed, is near the input opening 1*a*, after being cut by the cutter 8. Its front end is going to be engaged by the pair of input rollers 51. The tank 1 has been previously filled with new developing product, by the first measuring pump 21*b* through its respective nozzle 21. The input guide 41 is in its input position A, while the output guide 42 is in its raised position C.

The pairs of counter-rotating rollers 51,52 are then activated, with a pre-defined speed, according to a rotation direction which allows the pair of input rollers 51 to push the sheet 2 inside the tank 1, and the pair of output rollers 52 to rotate in the opposite direction. The sheet 2 then contacts the aforesaid developing product, and goes out of the tank 1 from the output opening 1*b*, where it is engaged by the output rollers 52.

In the meanwhile the draining valve 31 is activated, and the developing product is flown out of the tank 1. The second measuring pump 22*b* is then activated, in order to fill the tank 1 with new fixing product.

At the same time, the input guide 41 is moved to its raised position B (FIG. 2), and the roller 54 is activated, according to a rotation direction W. This allows the sheet 2 to be routed, with the co-operation of the small rollers 56, from the output rollers 52, along the upper portion 54*a* of the external surface of the roller 54, until it is engaged by the input rollers 51. The sheet 2 is then pushed again into the tank 1 where, while passing thereinto, it is subjected to a fixing cycle, for a pre-defined period of time. It is then engaged again by the output rollers 52, and subsequently routed out of the tank 1.

At the same time the fixing product is drained from the tank 1, and this latter is filled with a measured quantity of new washing product, usually clean water.

The sheet 2 is then engaged by the conveyor 53, and it is routed again into the tank 1, where it is subjected to a washing cycle. The output guide 42 is now moved to its output position D, and the sheet 2 is engaged by the output rollers 52 again and routed toward the pair of ejection rollers 9, and toward a drying device 7, of known type. The input guide 41 is then moved to its input position A, in order to allow a subsequent sheet 2 to be conveyed into the tank 1.

The washing product is finally drained from this latter, and it is filled again with a new measured quantity of developing product.

Obviously, two or more sheet washing cycle and/or tank prewash cycles can be performed if necessary, in order to completely eliminate the fixing product remains, which could contaminate the developing product.

The advantages arising from the present invention most of all consist in that all the sheet 2 portions stay in contact with the developing product and with the fixing product for a perfectly equal period of time. The duration of the developing and fixing cycles can be easily modified by simply varying the rotation speed of the input and output rollers.

What is claimed is:

1. Improved apparatus for processing a photosensitive medium, comprising: at least a tank (1), featuring a laminar cavity (3), fit to receive processing products for a sheet (2) made of photosensitive medium, and to receive also said sheet (2), in order to develop a latent image carried by the same; thermoregulating means (10), surrounding said tank (1) and fit to regulate its temperature to a pre-defined value; loading means (20) of said products inside said tank (1); draining means (30) of said products; guiding means (40) of said sheet (2), fit to guide this latter into said tank (1) and out therefrom; said apparatus being characterised in that said tank (1) has said laminar cavity (3) shaped like a rounded "U", having its concavity facing upwardly, and it is also provided at its opposite ends with at least two openings, respectively an input opening (1*a*), fit to receive said sheet (2), and an output opening (1*b*), fit to allow said sheet (2) to be transferred out of said laminar cavity (3), the position of said guiding means (40) being also adjustable to allow said sheet (2) to be routed along a closed loop.

2. Apparatus according to claim 1, characterised in that said tank (1) is substantially shaped as a semi-cylinder.

3. Apparatus according to claim 1, characterised in that there is also provided conveying means (50), fit to route said sheet (2), in a closed loop, inside the said tank (1), then out of said tank (1), and then inside the said tank (1) again, through said input opening (1*a*) and output opening (1*b*), for a pre-defined number of loops.

4. Apparatus according to claim 3, characterised in that said conveying means (50) comprise at least a pair of counter-rotating input rollers (51), arranged immediately above said input opening (1*a*), at least a pair of counter-rotating output rollers (52), arranged immediately above said output opening (1*b*), and at least a conveyor (53), placed above said tank (1) and fit to route said sheet (2) from said output opening (1*b*) to said input opening (1*a*), according to operating positions of said guiding means (40).

5. Apparatus according to claim 4, characterised in that said conveyor (53) comprises a roller (54), rotatably mounted above said tank (1), symmetrically with respect to this latter, and a plurality of small rollers (56), free-rotatably mounted in contact with the upper portion (54*a*) of the external surface of said roller (54), being moreover mounted parallel and counter-rotating with respect to the same roller (54) and being fit to route said sheet (2) along said upper portion (54*a*).

6. Apparatus according to claim 1, characterised in that said guiding means (40) comprises an input guide (41) and an output guide (42), consisting of a pair of curved plates, symmetrically mounted above said openings (1*a*,1*b*) and pivotable about their lower ends.

* * * * *